US005407363A

United States Patent [19]

Polgar et al.

[11] Patent Number: 5,407,363

[45] Date of Patent: Apr. 18, 1995

[54] FLOATING PANEL MOUNTING SYSTEM FOR ELECTRICAL CONNECTORS

[75] Inventors: Gary E. Polgar, Bolingbrook; John S. Luthy, Naperville; Rupert J. Fry, Des Plaines, all of Ill.

[73] Assignee: Molex Incorporated, Lisle, Ill.

[21] Appl. No.: 212,755

[22] Filed: Mar. 11, 1994

[51] Int. Cl.[6] ..... H01R 13/74

[52] U.S. Cl. ..... 439/546; 439/248; 248/222.3

[58] Field of Search ..... 439/546–549, 439/248, 247; 248/222.1, 222.3

[56] References Cited

U.S. PATENT DOCUMENTS

| | | | |
|---|---|---|---|
| 3,047,829 | 7/1962 | Mouat | 439/546 |
| 3,559,152 | 1/1971 | Pearce, Jr. | 439/548 |
| 3,912,355 | 10/1975 | Curado et al. | 439/546 |
| 4,005,924 | 2/1977 | Nestor | 439/57 |
| 4,029,953 | 6/1977 | Natoli | 439/546 |
| 4,373,771 | 2/1983 | Cross et al. | 439/332 |
| 4,427,255 | 1/1984 | Cox | 439/548 |
| 4,593,958 | 6/1986 | Baba | 439/77 |
| 4,804,343 | 2/1989 | Reedy | 439/336 |
| 4,934,951 | 6/1990 | Schonath | 439/86 |
| 5,017,151 | 5/1991 | Peterson | 439/248 |
| 5,279,506 | 1/1994 | Kawase et al. | 439/157 |

*Primary Examiner*—Gary F. Paumen

*Attorney, Agent, or Firm*—Stephen Z. Weiss

[57] ABSTRACT

An electrical connector panel mounting system includes a panel having a given thickness between two surfaces and including an opening formed with at least one locating slot extending radially from the opening. A connector includes a dielectric housing insertable from one surface of the panel along an axis to an insertion position into the opening in the panel. The housing has at least one radially extending locating flange for passing through the locating slot of the opening as the housing is inserted thereinto. At least one radially extending stop flange is spaced axially and angularly from the locating flange for abutting the one surface of the panel and preventing further insertion of the housing when the locating flange clears the opposite surface of the panel. A limiting slot extends radially from the opening in the panel. The limiting slot is separate, independent and angularly spaced from the locating slot and has a given angular width. A limiting tab is provided on the connector housing for engagement in the limiting slot when the connector is rotated about the axis from its insertion position to a mounted position and for preventing rotation of the connector away from the mounted position. The limiting tab has an angular width less than that of the limiting slot to allow for an amount of angular floating action between the connector and the panel when the connector is in its mounted position.

11 Claims, 6 Drawing Sheets

FLOATING PANEL MOUNTING SYSTEM FOR ELECTRICAL CONNECTORS

FIELD OF THE INVENTION

This invention generally relates to the art of electrical connectors and, particularly, to an electrical connector floating panel mounting system.

BACKGROUND OF THE INVENTION

Panel mounted electrical connectors usually include a non-conductive or dielectric housing having a plurality of electrically conductive terminals mounted therein. The housing also includes means for mounting the connector to a panel. The panel mounted connector is mateable with other electrical apparatus, such as another connector, which, in turn, may be mounted to a second panel, a circuit board, a cable or discrete wires.

Quite often, the mating of a panel mounted electrical connector to another connector or circuit component often is carried out under "blind mating" conditions such that precise alignment of the panel mounted connector with the other connector or circuit component cannot be assured. Blind mating of panel mounted connectors may occur in a wide variety of applications including components of copying machines, computer equipment, telecommunications equipment and like applications. Attempts to forcibly blind mate improperly aligned electrical connectors can damage the housings of the connectors, the fragile terminals of the housings or the panels to which the connectors are mounted. Improper alignment also may prevent complete mating, thereby negatively affecting the quality of the electrical connection.

Various prior art panel mounted electrical connectors have been provided with means for permitting a controlled amount of float between the connector housing and the associated panel to solve the above problems in blind mating of panel mounted connectors. Many such connectors have been fairly complex multi-component structures which may even be manufactured separately from the electrical connector and require complex assembly and installation.

These problems are discussed in U.S. Pat. No. 5,017,151 to Peterson, dated May 21, 1991 and assigned to assignee of the present invention, and which is incorporated herein by reference. In addition to discussing the problems of the prior art, that patent shows a floating panel mount for an electrical connector to facilitate blind mating applications. Although the system of that patent, employing the use of separate mounting posts extending from the connector, has proven quite effective for its intended purposes, the separate mounting posts of that system use up too much space or "real estate" on the panel for some applications.

The present invention is directed to still further improvements in such floating panel mounting systems and wherein substantially no extraneous space-demanding components are employed.

SUMMARY OF THE INVENTION

An object, therefore, of the invention is to provide an improved floating panel mounting system for electrical connectors of the character described.

In the exemplary embodiment of the invention, the system includes a panel having a given thickness between two surfaces and including an opening formed with at least one locating slot extending radially from the opening. A connector has a dielectric housing insertable from one surface of the panel along an axis to an insertion position into the opening in the panel. The housing has at least one radially extending flange for passing through the locating slot of the opening as the housing is inserted thereinto. At least one radially extending stop flange is spaced axially and angularly from the locating flange for abutting the one surface of the panel and preventing further insertion of the housing when the locating flange clears the opposite surface of the panel.

The invention contemplates the provision of a limiting slot extending radially from the opening in the panel. The rotation limiting slot is separate, independent and angularly spaced from the locating slot and has a given angular width. A rotational limiting tab on the connector housing engages in the rotation limiting slot when the connector is rotated from its insertion position to a mounted position to allow limited rotational movement of the connector while preventing its rotation back to its insertion position. The rotation limiting tab has an angular width less than that of the rotation limiting slot to allow for an amount of angular floating action between the connector and the panel when the connector is in its mounted position.

As disclosed herein, the angular width of the limiting slot is greater than the angular width of the limiting tab an amount sufficient to allow for approximately six degrees of relative angular movement between the connector and the panel.

Another feature includes the provision of a stop block extending radially of the connector housing for engaging an edge of the locating slot to prevent rotation of the connector beyond its mounted position opposite its insertion position. In the preferred embodiment, the stop block is located at one angular end of the stop flange. The limiting tab is located at an opposite end of the stop flange. The housing is molded of dielectric plastic material with the locating flange, the stop flange, the limiting tab and the stop block all being molded integrally therewith.

The panel further includes a second locating slot, and the connector includes a complementarily configured second locating flange spaced angularly of the one locating slot and flange. The second locating slot and second locating flange are adapted to provide for polarization of the connector upon insertion into the opening in the panel.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
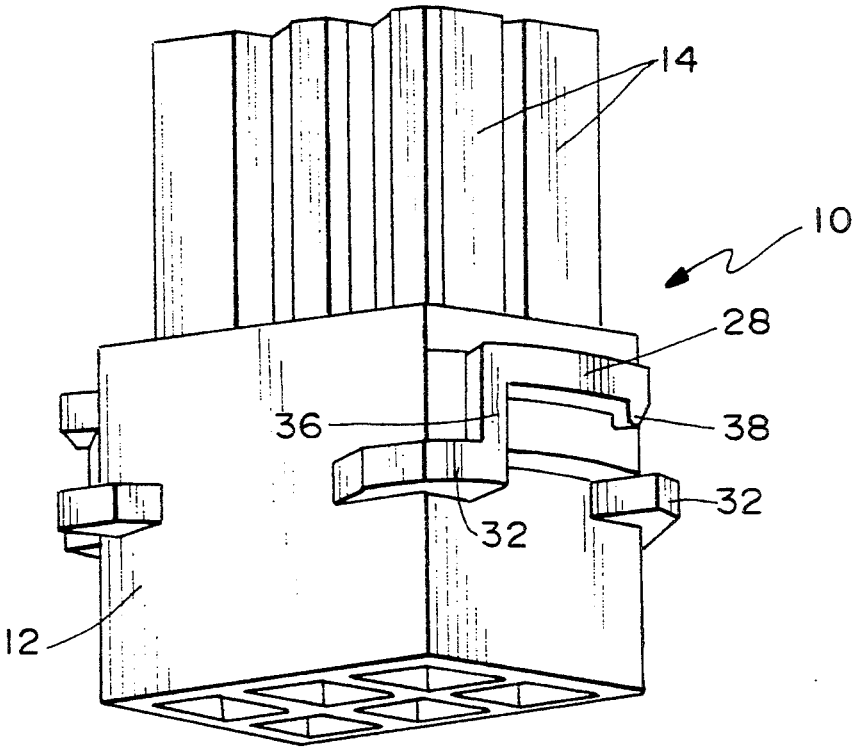
FIG. 1 is a perspective view of an electrical connector embodied in the floating panel mount system of the invention.

Referring to the drawings in greater detail, and first to FIGS. 1–6, the electrical connector panel mounting system of the invention includes an electrical connector, generally designated 10, having a dielectric housing 12 unitarily molded of plastic material or the like. The housing has a plurality of integrally molded silos 14 within which a plurality of electrical terminals are located. The silos form a mating end of the housing or connector which is blind mated to a complementary connector apparatus, as described hereinafter.

Figure 7:
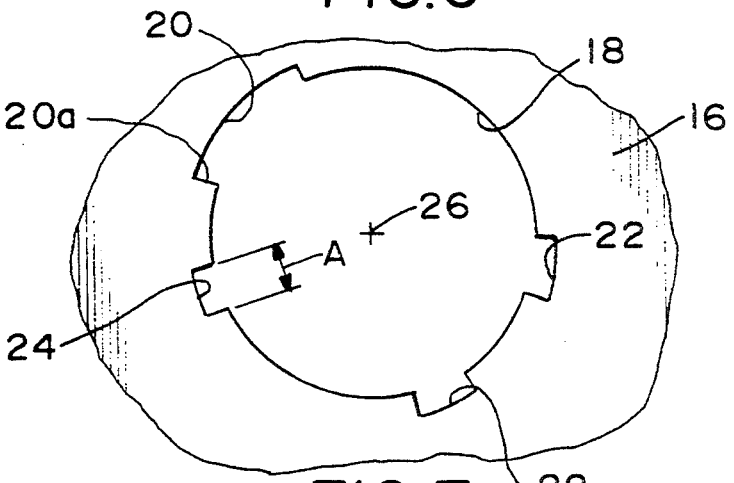
FIG. 7 is a plan view of the opening in the panel within which the connector is mounted.

Before proceeding with further details of connector 10, reference first is made to FIG. 7 wherein a portion of a panel 16 is shown to include an opening 18. The opening is formed with a first locating slot 20 extending radially from opening 18, as well as a pair of second locating slots 22 also extending radially from the opening but generally on a diametrically opposite side of the opening from first locating slot 20. Lastly, a rotation limiting slot 24 extends radially from opening 18 in panel 16. The rotation limiting slot is separate, independent and angularly spaced from locating slots 20 and 22 as clearly shown in FIG. 7. The limiting slot has a given angular width as indicated by double-headed arrow "A". In essence, opening 18 in panel 16 defines a center axis 26 which is the insertion axis of connector 10.

Turning back to FIGS. 1–6, dielectric housing 12 of connector 10 includes a first radially extending locating flange 28 which is sized for insertion through locating slot 20 in panel 16 (FIG. 7). A pair of second locating flanges 30 extend radially of housing 12 and are sized for insertion into second locating slots 22 in panel 16. In comparing FIGS. 1 and 2 or in comparing FIGS. 5 and 6, it can be seen that first locating flange 28 is on a diametrically opposite side of housing 18 from second locating flanges 30. The differently configured flanges and slots provide for polarization of the connector upon insertion into opening 18 in the panel.

Figure 2:
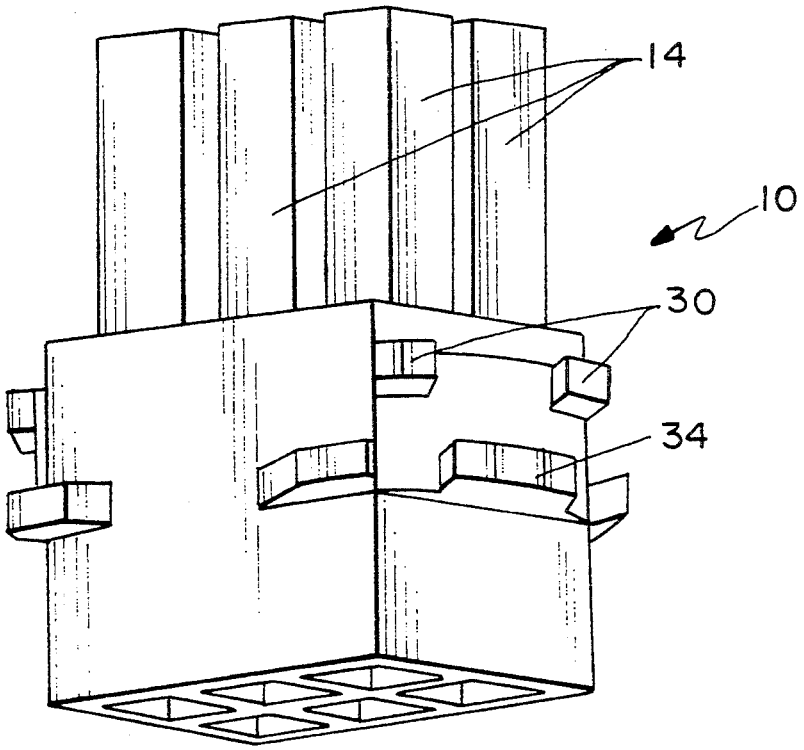
FIG. 2 is a perspective view similar to that of FIG. 1 but looking at the opposite side of the connector.
Figure 4:
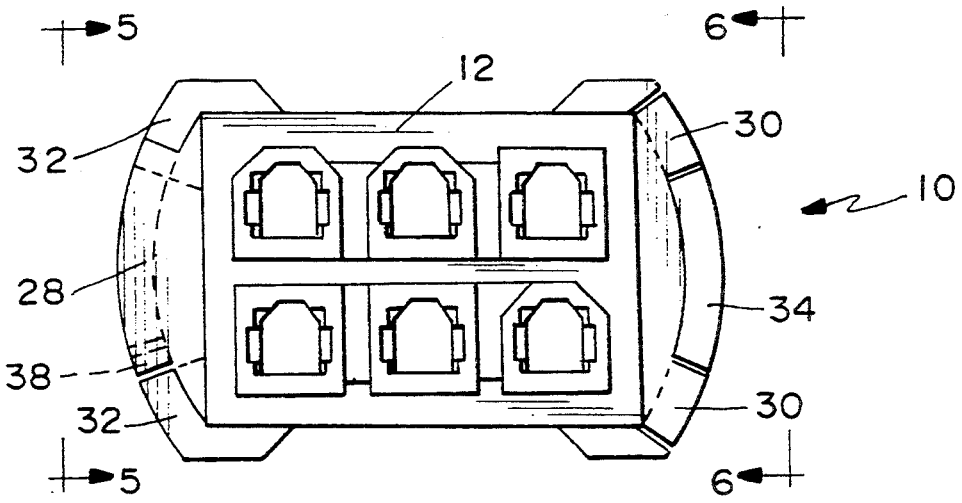
FIG. 4 is a top plan view of the connector in relation to FIGS. 1–3.
Figure 5:
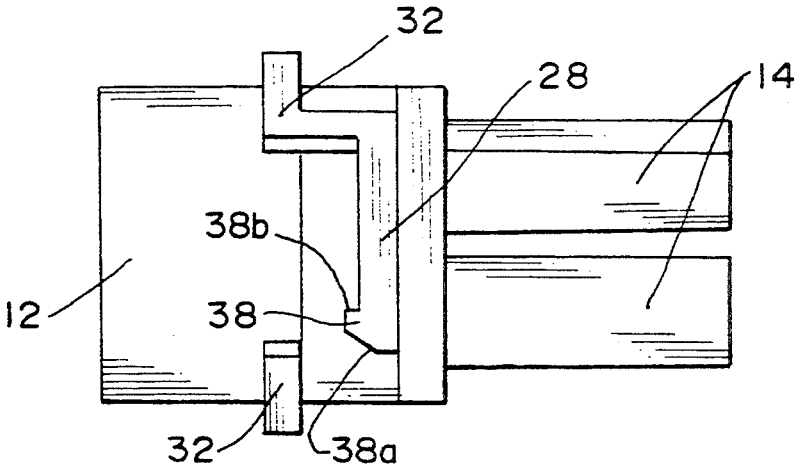
FIG. 5 is an end elevational view looking toward the left-hand end of FIG. 4.
Figure 6:
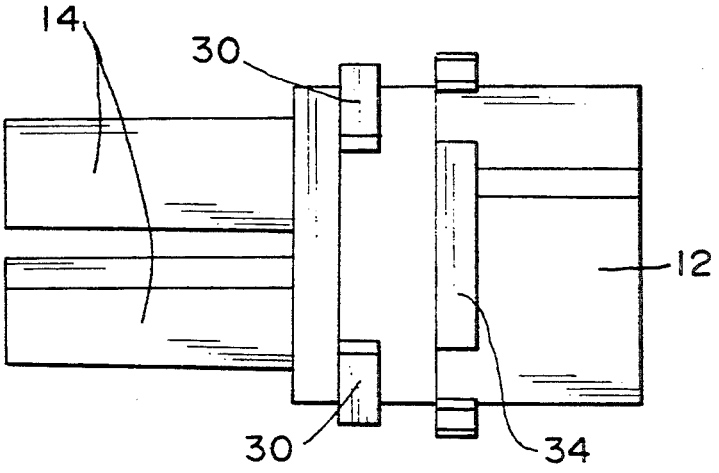
FIG. 6 is an end elevational view looking toward the right-hand end of FIG. 4.

As connector 10 is inserted into opening 18 in the panel, by passing the locating flanges 28 and 30 through locating slots 20 and 22, respectively, various radially extending stop flanges are provided for defining the fully inserted position of the connector. More particularly, as seen in FIGS. 1 and 5, a pair of radially extending stop flanges 32 are spaced axially and angularly outwardly from locating flange 28. As seen in FIGS. 2 and 6, a radially extending stop flange 34 is spaced axially and angularly from locating flanges 30. In fact, it can be seen that stop flange 34 is located angularly between locating flanges 30. Therefore, when connector 10 is inserted into opening 18 in panel 16, locating flanges 28 and 30 will pass through locating slots 20 and 22, respectively, in the panel, but stop flanges 32 and 34 will abut against the surface of the panel on the insertion side thereof. The connector then can be rotated a given degree so that locating flanges 28 and 30 are juxtaposed on the opposite surface of the panel whereby the connector is prevented from moving axially relative to the panel.

Generally, stop means are provided to limit the rotation of connector 10 from its insertion position to its furthest mounted position, but not any further. In particular, as seen in FIGS. 1 and 5, a stop block 36 spans locating flange 28 and the left-hand stop flange 32 for engaging an edge of locating slot 20 of the panel opening to prevent rotation of the connector beyond its furthest mounted position, as described hereinafter.

As stated above, housing 12 and silos 14 are unitarily molded of dielectric material such as plastic or the like. Locating flanges 28 and 30, stop flanges 32 and 34 and stop block 36 all are molded integrally with and extend radially outwardly of the housing.

Figure 3:
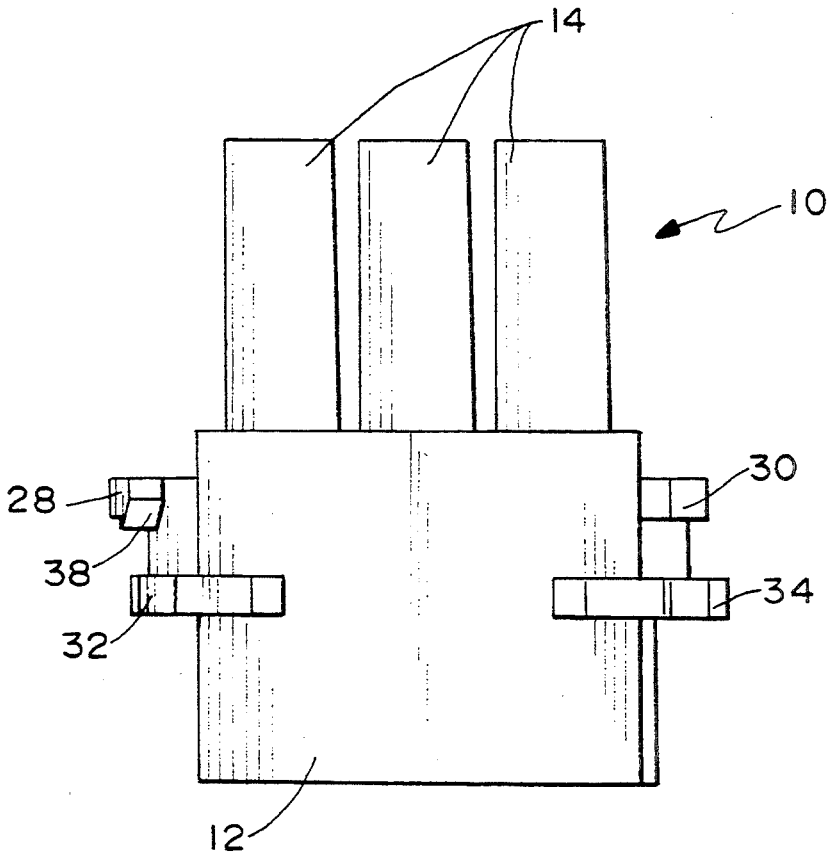
FIG. 3 is a side elevational view of the connector.

Lastly in referring to FIGS. 1–6, and particularly to FIGS. 1, 3 and 5, a limiting tab 38 is formed integrally with and projects axially at one end of locating flange 28. Therefore, stop block 36 is at one end of locating flange 28 and limiting tab 38 is at the other end of the flange. The limiting tab is adapted for engagement in the limiting slot 24 (FIG. 7) which extends radially from opening 18 in panel 16. The limiting tab is provided to allow limited rotational movement of the connector in its mounted position while preventing its rotation back to its insertion position. As will be described hereinafter, the relationship between the limiting tab and the limiting slot allows for an amount of angular floating action between the connector and the panel when the connector is in its mounted position.

Figure 8:
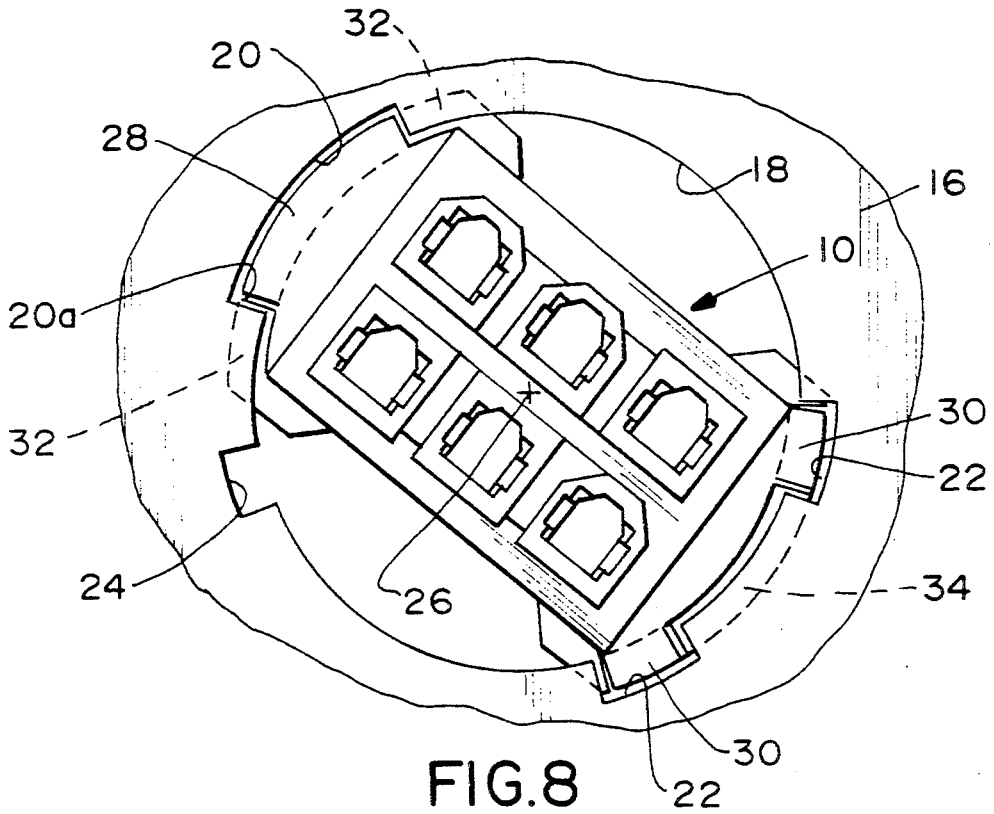
FIG. 8 is a plan view showing the connector in its insertion position relative to the panel and its opening.

The operation of the floating electrical connector panel mounting system of the invention now will be described in relation to FIGS. 8–11. Referring first to FIG. 8, the angular insertion position of connector 10 relative to panel 16 and opening 18 is shown. It can be seen that locating flange 28 is angularly aligned with locating slot 20 for insertion therethrough, and locating flanges 30 are aligned with locating slots 22 for insertion therethrough. The amount of movement of the connector axially into and through opening 18 is determined by the axial spacing of stop flanges 32 and 34 from locating flanges 28 and 30. The spacing between the locating flanges and the stop flanges must be at least equal to the thickness of panel 16 so that no frictional forces exist between the flanges and the panel. As viewed in FIG. 8, stop flanges 32 and 34 are shown beneath panel 16, in that the stop flanges have abutted against the underside of panel 16 as viewed therein.

Figure 9:
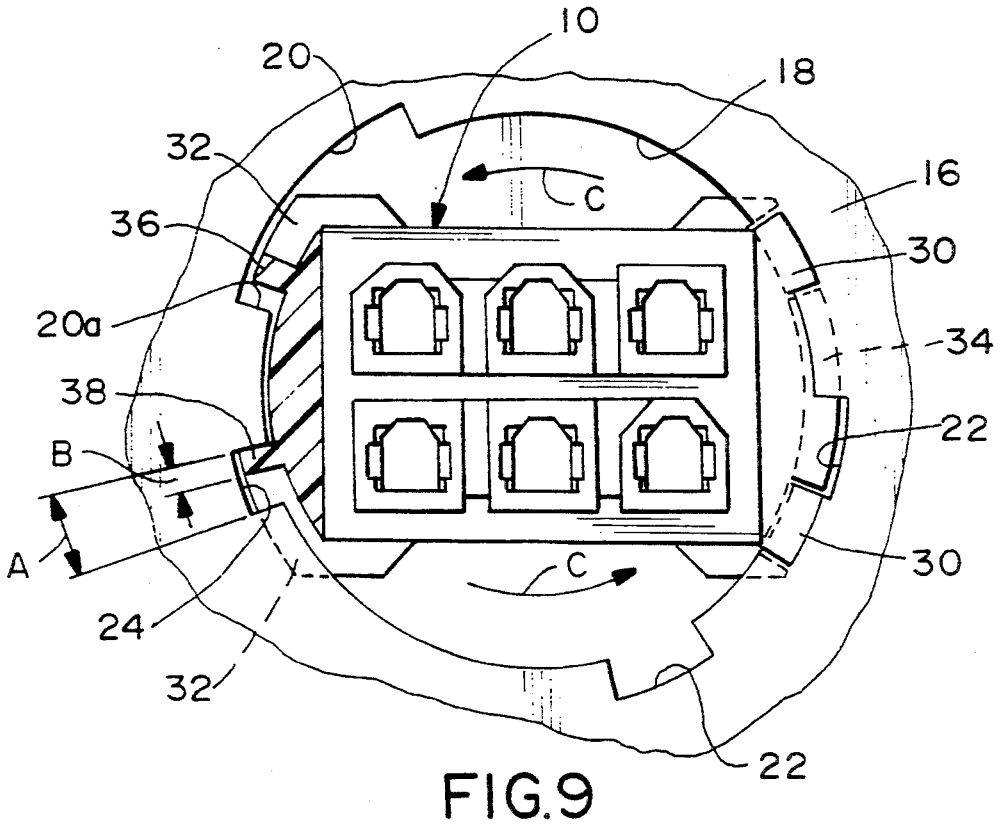
FIG. 9 is a view similar to that of FIG. 8, showing the connector having been rotated to its mounted position.

After locating flanges 28 and 30 have fully cleared the top surface of panel 16 as viewed in FIG. 8, connector 10 then is rotated in the direction of arrows "B" in FIG. 9, until limiting tab 38 snaps into limiting slot 24. It should be understood that the distance between the axial tip of limiting tab 38 (see FIG. 1) and the right-hand locking flange 32 is slightly less than the thickness of panel 16 so that, due to the compliancy of the plastic material of limiting tab 38, the tab can snap into limiting slot 24.

As stated above, the relationship between the limiting tab 38 and limiting slot 24 is such as to allow for an amount of angular floating action between the connector and the panel when the connector is in its mounted position. This relationship is provided by making the angular width "A" (FIG. 7) of limiting slot 24 greater than the angular width "B" (FIG. 9) of limiting tab 38. This differential clearly can be seen in FIG. 9.

Figure 10:
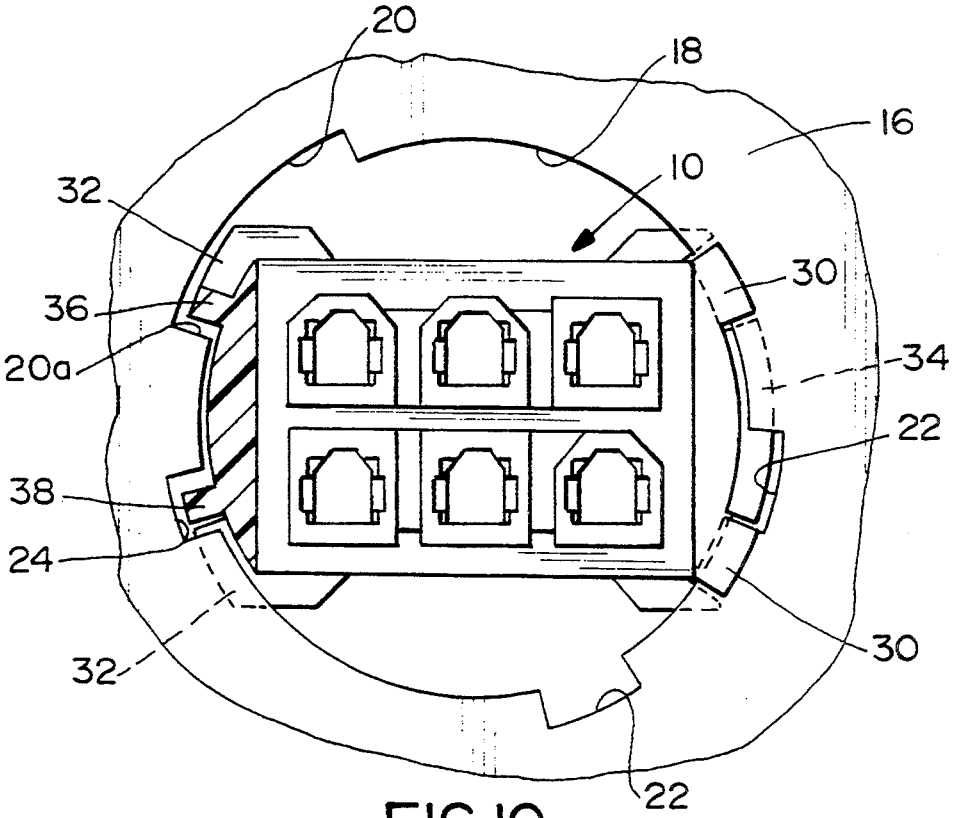
FIG. 10 is a view similar to that of FIG. 9, with the rotation limiting tab located generally centrally of the rotation limiting slot.
Figure 11:
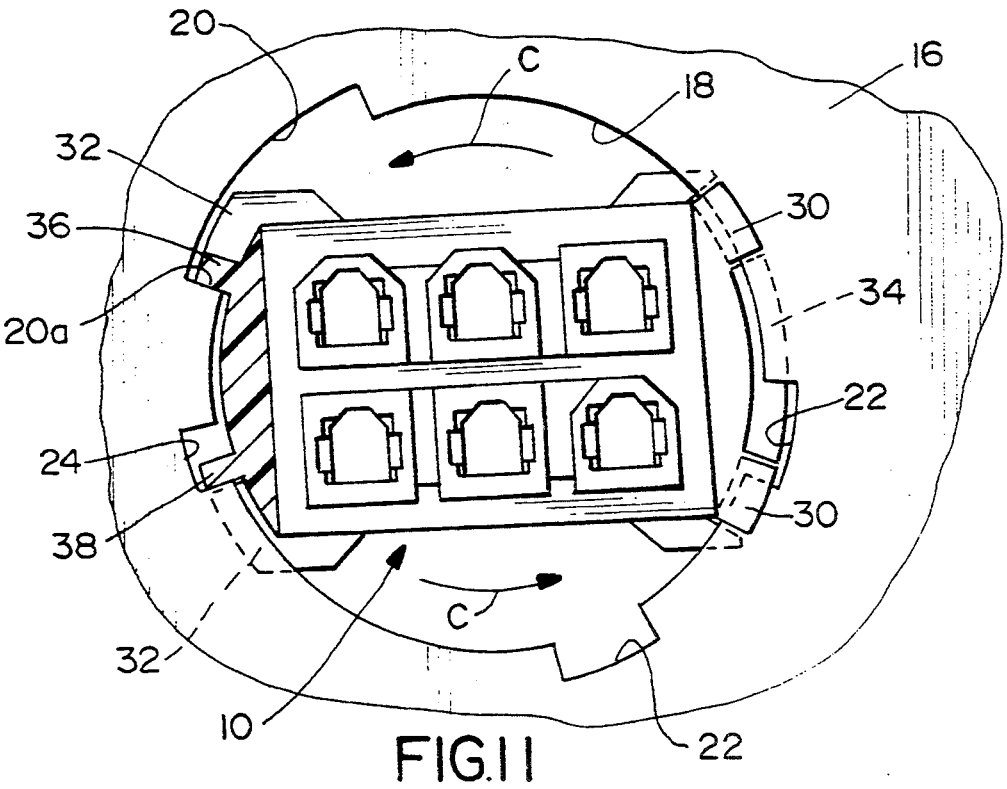
FIG. 11 is a view similar to that of FIGS. 9 and 10, with the rotation limiting tab located at an extreme edge of the rotation limiting slot, i.e. opposite the extreme edge of FIG. 9.

Now, comparing FIGS. 9–11, it can be seen that limiting tab 38 is at one edge of limiting slot 24 in FIG. 9; the limiting tab is at the opposite edge of the slot in FIG. 11; and the limiting tab generally is in the center of the slot in FIG. 10. In FIG. 11, it can be seen that when the limiting tab is at the opposite edge of the limiting slot, stop block 36 abuts edge 20*a* of locating slot 20 to prevent any further rotational movement of the connector relative to the panel in the direction of arrows "C". In the illustrated embodiment, the angular width of the limiting slot is greater than the angular width of the limiting tab an amount sufficient to allow for approximately six degrees of relative angular movement between the connector and the panel. In other words, with the connector in its mounted position, limiting tab 38 can move from its center position shown in FIG. 10 approximately three degrees in either angular direction to either of the positions at the opposite edges of limiting slot 24 shown in FIGS. 9 and 11.

Reference is made back to FIG. 5 wherein it can be seen that limiting tab 38 is provided with a chamfered or angled "leading" surface 38*a* and an abrupt "trailing" surface 38*b*. Chamfered surface 38*a* facilitates the limiting tab to ride over an edge 20*a* (FIG. 8) of locating slot 20, and then across the surface of the panel until the limiting tab snaps into limiting slot 24. However, the abrupt trailing surface 38*b* of the limiting tab and the stop block 36 abutting edge 20*a* of the locating slot 20 prevents any reverse rotation which would allow the tab to move out of limiting slot 24.

It is significant to note that limiting slot 24 in panel 16 is separate and independent from any of the locating slots 20 and 22. By making the limiting slot totally independent, the given width "A" (FIG. 7) of the limiting slot can be varied quite inexpensively and efficiently without changing the construction of connector 10 in any way. By varying the width of the limiting slot, the amount of rotational floating action between the connector and the panel can be varied. Heretofore, with the complex construction of many floating panel mount systems, varying the amount of floating action between a connector and a panel was difficult, very expensive or even impossible without significantly changing the connector itself. Cutting limiting slot 24 to a different width is a very simple procedure and allows for varying the floating action of connector 10 without in any way changing the connector.

Figure 12:
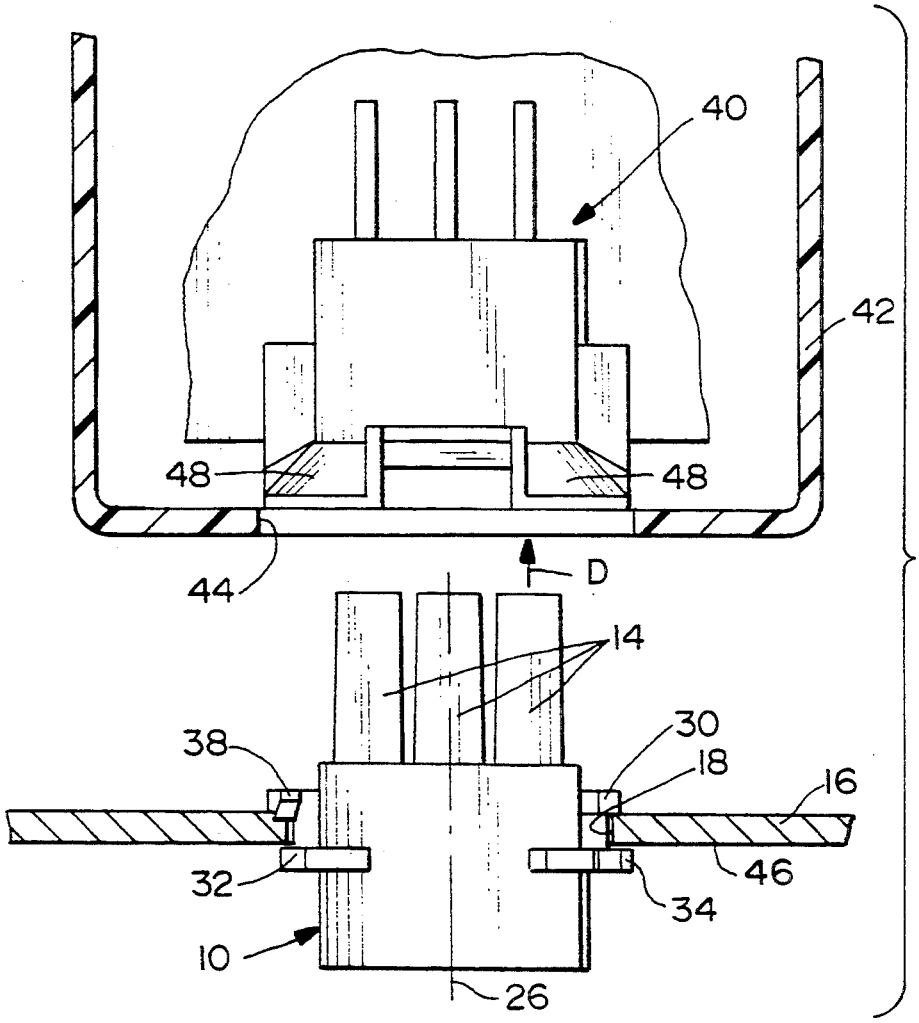
FIG. 12 is an elevational view of the connector mounted in the panel, in conjunction with a complementary blind mateable connector apparatus.
Figure 13:
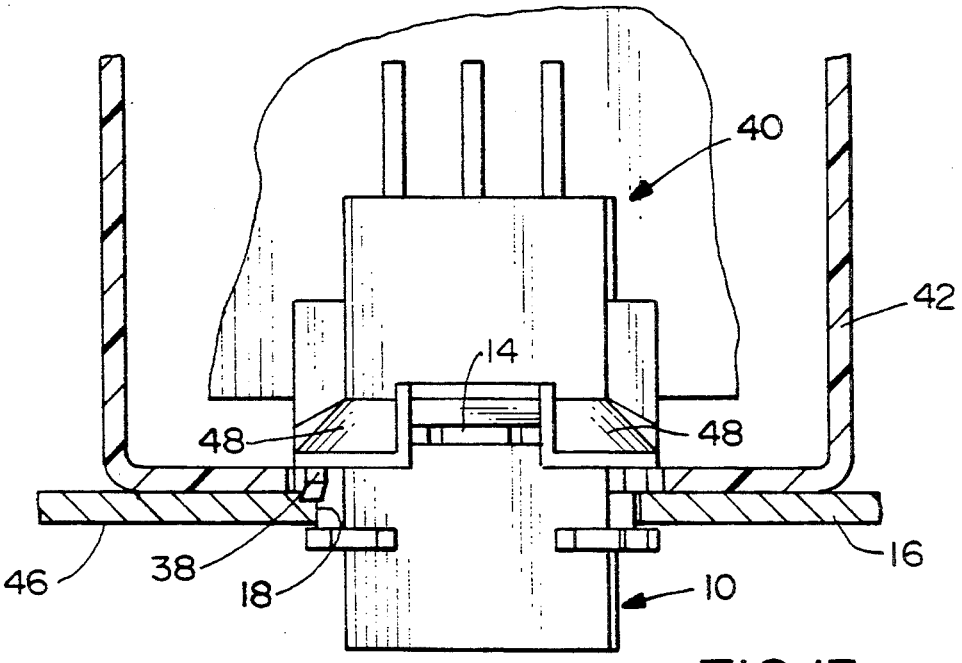
FIG. 13 is a view similar to that of FIG. 12, with the connector mated to the complementary connector apparatus.

Lastly, FIGS. 12 and 13 simply show connector 10 mounted within opening 18 in panel 16 in its mounted/-floating position. The connector and panel are mateable in the direction of arrow "D" (FIG. 12) with a complementary connector apparatus, generally designated 40, mounted within a cup-shaped bracket or shield 42. The bracket has an opening 44 for the insertion therethrough of connector 10. It can be understood that an operator on the outside of panel 16 (i.e. facing surface 46 of the panel), cannot see connector apparatus 40. This type of application is what is commonly termed a "blind mating" application. However, with connector 10 allowed to float relative to panel 16, particularly in an angular direction about axis 26, the connector (i.e. silos 14) is allowed to "find" its proper alignment for mating of the connectors. Various connector apparatus, such as connector apparatus 40, are provided with chamfered guide walls 48 which engage the distal ends of silos 14 to guide the silos into the receptacles of connector apparatus 40. However, even with the provision of such chamfered walls 48, blind mating is extremely difficult without the floating action between connector 10 and panel 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

It is claimed:

1. In an electrical connector panel mounting system which includes a panel having a given thickness between two surfaces and including an opening formed with at least one locating slot extending radially from the opening, and a connector having a dielectric housing insertable from one surface of the panel along an axis to an insertion position into the opening in the panel, the housing having at least one radially extending locating flange for passing through the locating slot of the opening as the housing is inserted thereinto and at least one radially extending stop flange spaced axially and angularly from the locating flange for abutting the one surface of the housing when the locating flange clears the opposite surface of the panel, wherein the improvement comprises a limiting slot extending radially from the opening in the panel, the limiting slot being separate, independent and angularly spaced from said locating slot and having a given angular width, and a limiting tab on the connector housing for engagement in said limiting slot when the connector is rotated about said axis from its insertion position to a mounted position and for preventing rotation of the connector away from the mounted position, the limiting tab having an angular width less than that of the limiting slot to allow for an amount of angular floating action about the axis of the connector between the connector and the panel when the connector is in its mounted position.

2. In an electrical connector panel mounting system as set forth in claim 1, wherein the angular width of said limiting slot is greater than the angular width of said limiting tab an amount sufficient to allow for approximately six degrees of relative angular movement between the connector and the panel.

3. In an electrical connector panel mounting system as set forth in claim 1, wherein said limiting tab is located at one angular end of said locating flange.

4. In an electrical connector panel mounting system as set forth in claim 1, including a stop block extending radially of the connector housing for engaging an edge of the locating slot to prevent rotation of the connector beyond said mounted position.

5. In an electrical connector panel mounting system as set forth in claim 4, wherein said stop block is located at one angular end of said locating flange.

6. In an electrical connector panel mounting system as set forth in claim 5, wherein said limiting tab is located at an opposite end of said locating flange.

7. In an electrical connector panel mounting system as set forth in claim 6, wherein said housing is molded of dielectric plastic material with said locating flange, said stop flange, said limiting tab and said stop block all being molded integrally therewith.

8. In an electrical connector panel mounting system as set forth in claim 1, including a second locating slot in the panel and a complementarily configured second locating flange on the connector housing spaced angularly of said one locating slot and adapted to provide for polarization of the connector upon insertion into the opening in the panel.

9. In an electrical connector panel mounting system as set forth in claim 1, wherein said limiting tab has a chamfered leading edge for facilitating movement of the limiting tab into the limiting slot.

10. In an electrical connector panel mounting system as set forth in claim 9, wherein said limiting tab has an abrupt trailing edge for preventing movement of the limiting tab back out of the limiting slot.

11. In an electrical connector panel mounting system as set forth in claim 10, including a stop block extending radially of the connector housing for engaging an edge of the locating slot to prevent rotation of the connector beyond its mounted position.

* * * * *